US006003750A

United States Patent [19]

Hermsen

[11] Patent Number: 6,003,750

[45] **Date of Patent: *Dec. 21, 1999**

[54] PROCESS FOR GUIDING A WEB

[75] Inventor: Thomas Hermsen, Issum, Germany

[73] Assignee: Voith Sulzer Finishing GmbH, Krefeld, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/896,129

[22] Filed: Jul. 17, 1997

[30] Foreign Application Priority Data

Jul. 20, 1996 [DE] Germany ..... 196 29 323

[51] Int. Cl.[6] ..... G03B 1/56; B65H 20/00

[52] U.S. Cl. ..... 226/91; 226/95; 226/97.3; 162/255

[58] Field of Search ..... 242/615.11; 226/95, 226/97.3, 15, 91, 92; 162/255

[56] References Cited

U.S. PATENT DOCUMENTS

| | | | |
|---|---|---|---|
| 3,327,916 | 6/1967 | Weidenhammer et al. | 242/615.11 |
| 3,355,349 | 11/1967 | Devlin | 162/286 |
| 3,705,676 | 12/1972 | Overly et al. | 226/97.3 |
| 3,999,696 | 12/1976 | Reba et al. | 226/91 X |
| 4,014,487 | 3/1977 | Reba et al. | 226/91 X |
| 4,022,366 | 5/1977 | Rooney | 226/91 |
| 4,183,451 | 1/1980 | Gageur . | |
| 4,513,517 | 4/1985 | Vedenpaa | 226/91 X |
| 4,692,215 | 9/1987 | Kerttula | 162/255 X |
| 4,763,822 | 8/1988 | Mohrsen . | |
| 4,904,344 | 2/1990 | Peiffer | 226/91 X |
| 4,923,567 | 5/1990 | Liedes et al. | 242/615.11 X |
| 5,143,364 | 9/1992 | Kharzo et al. . | |
| 5,172,844 | 12/1992 | Mueller | 226/97.3 X |
| 5,184,813 | 2/1993 | Schwitzky et al. . | |
| 5,308,005 | 5/1994 | Hutteman et al. | 226/95 X |
| 5,356,127 | 10/1994 | Moore et al. . | |
| 5,395,029 | 3/1995 | Kurie | 242/615.11 |

FOREIGN PATENT DOCUMENTS

| | | |
|---|---|---|
| 509349 | 4/1979 | Australia . |
| 503623 | 9/1992 | European Pat. Off. . |
| 232689 | 8/1997 | European Pat. Off. . |
| 4241400 | 6/1993 | Germany . |
| 2006292 | 5/1979 | United Kingdom . |

*Primary Examiner*—Michael R. Mansen
*Attorney, Agent, or Firm*—Greenblum & Bernstein P.L.C.

[57] ABSTRACT

Process for guiding a web from one treatment station to another in a web manufacturing or treatment process. The process includes guiding the web with at least one pneumatic support device and controlling air pressure in the at least one pneumatic support device via a microprocessor. The air pressure is related to at least one quality factor of the web.

20 Claims, 1 Drawing Sheet

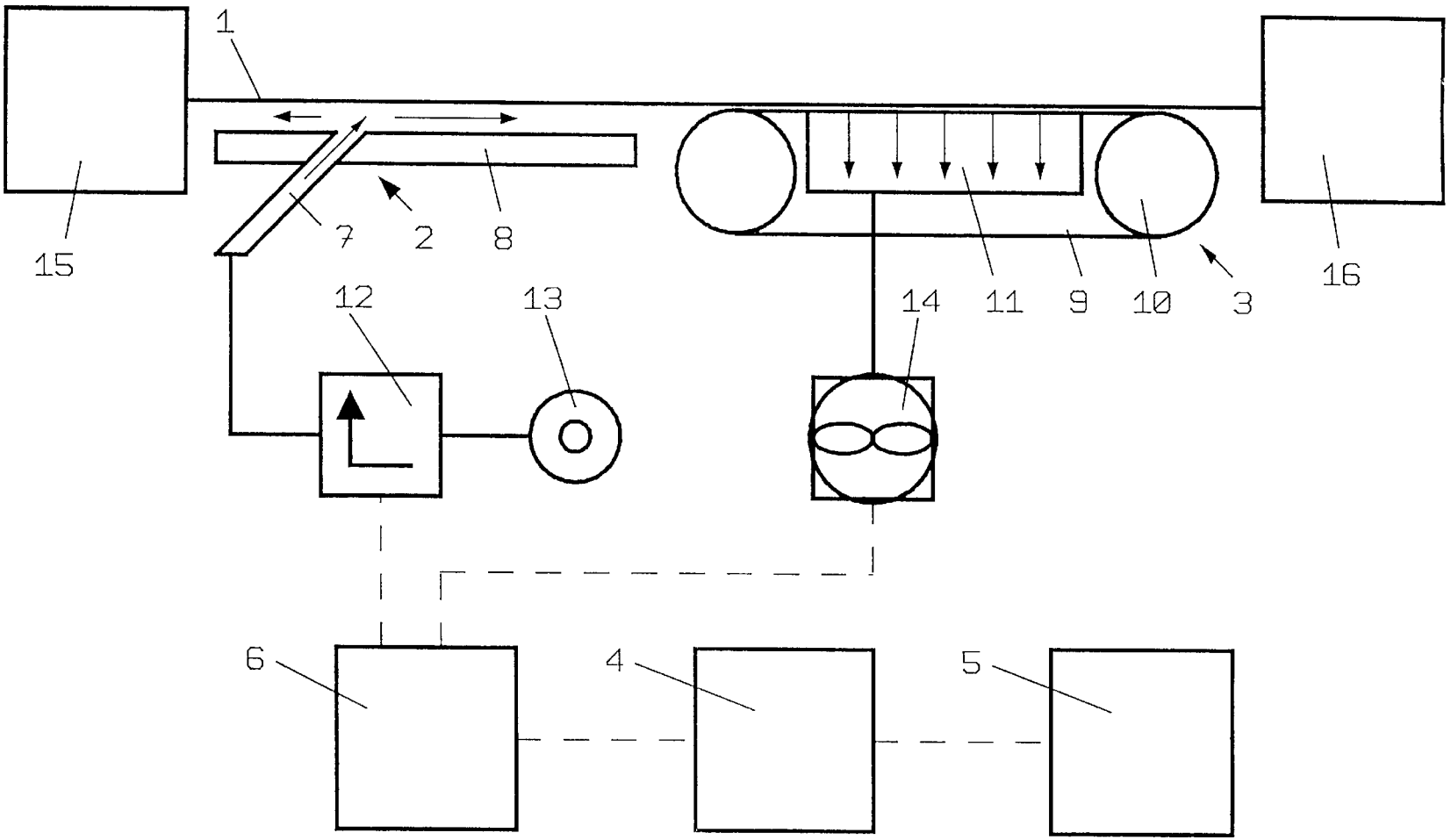
16
3
10
9
11
14
13
8
2
7
12
1
15
5
4
6

PROCESS FOR GUIDING A WEB

CROSS-REFERENCE TO RELATED APPLICATION

The present invention claims the priority under 35 U.S.C. §119 of German Patent Application No. 196 29 323.5 filed Jul. 20, 1996, the disclosure of which is expressly incorporated by reference herein in its entirety.

BACKGROUND OF THE INVENTION

1. Field of the Invention

The present invention relates to a process for guiding a web, in particular a paper web, such as a continuous paper web or a paper strip cut therefrom, in a web manufacturing or treatment process with the aid of a pneumatically supported device.

2. Discussion of Background Information

Pneumatic support devices for guiding a paper web, or at least a paper strip cut therefrom, are disclosed, for example, in EP 0 232 689 A2. In such pneumatic support devices, one can generally distinguish between compressed air guidance devices that create air cushions with jets and guide media on which the paper sheet or paper strip is guided, and suction and transport devices that create a vacuum with the paper sheet or paper strip and guide the same to a concurrently running perforated endless conveyor belt.

For example, suppose a paper sheet has to be guided at a high rate of speed from the last cylinder of a drying cylinder group of a paper manufacturing process to the roll opening of a calender. For this purpose, a wide strip of paper (e.g., 20–40 cm) is cut off from the running paper sheet behind the last drying cylinder and is guided to the first roll opening of the calendar with known pneumatically supported devices. Meanwhile, the larger portion of the paper sheet, which can have a width of approximately 8 m, is guided back to pulp treatment. Only when the strip successfully passes to the next treatment step in the paper manufacturing process (in the selected example the calender), is the strip gradually cut wider by moving cutting knives across the paper sheet until the entire paper sheet width runs to the next treatment station.

The guidance of the strip is often associated with significant difficulties adjusting the correct air pressure (either too much pressure for the jets, or too little suction pressure on the perforated conveyor belts). In particular, if the paper quality of new products changes—here principally the weight—or the paper sheet speed, the pressures have to be newly adjusted, which is costly, time-consuming, and can lead to significant waste, since one has to wait for the width cut of the paper sheet until the strip has been properly guided to the next treatment station.

SUMMARY OF THE INVENTION

The object of the present invention is provide a process in which a web, in particular a paper web, such as a continuous paper web or a paper strip cut therefrom, and including a first end, can be guided from one treatment station to the next in a more efficient manner.

In paper manufacturing or treatment processes, the paper web has to be transported from one treatment station (for example, a drying cylinder) to the next station (for example, a calender). For this, pneumatic support devices, known from EP 0 232 689 A2, are used to guide a running paper sheet, or at least a paper strip cut therefrom. It is common during paper manufacturing and processing that the qualities of the paper vary, for example, because light weight as well as heavy weight papers are produced. Moreover, it is absolutely necessary to consider the additional parameters of paper smoothness, porosity, and stiffness, as well as the specific weight of the paper. In light of these paper quality parameters, the air pressures of pneumatic paper guiding devices have to be adjusted until it is possible to guide the paper sheet or strip at a very high speed (up to 2000 m/min) from one treatment station to the next.

The present invention is based on the recognition that the transfer process unfolds significantly safer and faster if the air pressure required for a pneumatic support device that guides the web is adjusted via a microprocessor, based on the respective processed paper quality. For this, data regarding paper quality factors may be entered in an operator unit, or it may be supplied via a measuring device.

According to the present invention, a microprocessor can be used to supply information about the required air pressure of the control unit with programmed computational steps, or with the aid of empirically derived values stored in memory. Preferably, the microprocessor directly controls the pressure control unit of at least one regulating unit. Pressure valves or suction fans can, for example, be controlled from the control unit so that the pneumatic support device for guiding a running paper sheet, or a paper strip cut therefrom, is supplied with the required pressure.

In a particularly advantageous object of the present invention, the machine operator enters only processed paper quality information into the operator unit of the microprocessor, in which case the required pressures of the individual pneumatic support devices are then determined automatically. Such a pneumatic support device for guiding a running paper sheet, or a paper strip cut therefrom, can, for example, be a compressed air guidance device or a suction-and-transport device. In this regard, it may be suitable to enter only the paper weight quality parameter into the operator unit of the microprocessor, as the air pressures of the pneumatic support devices mainly depend on the weight of the paper.

In another aspect of the present invention, information about the paper sheet's transfer speed or pull strength on the subsequent treatment stations, in addition to information about paper weight, may be considered by the microprocessor in determining the individual pressures of the pneumatic support devices. Information about paper sheet speed and pull are continuously determined in a conventional process anyway, and they can be supplied to the microprocessor without difficulty via electronic data processing. The paper sheet speed and paper sheet pull do not have a great influence on the required air pressures, but they do have some effect which, if ignored, could possibly prevent a successful transfer of a paper sheet strip from one treatment station to another.

The two parameters are also significant for the duty cycle of the pressure control unit. The higher the web speed and the higher the web pull, the sooner the over- or underpressure can be reduced again and the web can be cut to its full width. It is therefore useful if the duration of the pressure application is also determined by the microprocessor.

The present invention provides a process for guiding a web, in particular a paper web, such as a continuous paper web or a paper strip cut therefrom, from one treatment station to another in a web manufacturing or treatment process, comprising guiding the web with at least one pneumatic support device, and controlling the air pressure of the pneumatic support device via a microprocessor utilizing at least one quality factor of the web. The process may further include the microprocessor determining the air pressure in the pneumatic support device after the quality factor of the web is entered in an operating unit of the microprocessor. The process may also include controlling a control unit of at least one regulating unit with the microprocessor. The process may further comprise entering the weight of the web as the quality factor. The process of the present invention may include entering the weight of the web, the web speed and the web pull as the quality factors. The process of the present invention also may further comprise the microprocessor determining the duration of roller pressure.

BRIEF DESCRIPTION OF THE DRAWING

The present invention is further described in the detailed description which follows, in reference to the noted drawing by way of non-limiting examples of preferred embodiments of the present invention, wherein:

FIG. 1 illustrates a schematic representation of the pneumatic support devices that may be used for processing a paper sheet, or a strip cut therefrom, according to the present invention.

DETAILED DESCRIPTION

The particulars shown herein are by way of example and for purposes of illustrative discussion of the preferred embodiments of the present invention only, and are presented to provide what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the several forms of the invention may be embodied in practice.

As illustrated in FIG. 1, a paper sheet 1 is to be transferred from a treatment station 15 to another treatment station 16. The phrase "treatment station" may apply to various paper processing devices, such as a drying cylinder, a roll opening of a calender, or a winding-up device. For this reason, the treatment stations of FIG. 1 are only depicted in the form of boxes 15, 16.

Pneumatic support devices 2, 3 for guiding a running paper sheet, or a paper strip cut therefrom, are known. For example, support device 2 includes an air deflector 8 that creates an air cushion on which the paper sheet or strip floats at a high rate of speed, with the aid of an air jet 7. Air jet 7 is supplied by a compressed air source 13, via a regulator valve 12 that is controlled by the control unit 6.

Alternatively, support device 3, as depicted in FIG. 1, includes a perforated conveyor belt 9 that runs over rollers 10. Not shown in FIG. 1 is the driving apparatus of at least one roller 10. A suction box 11, creating a vacuum, is located below the belt. The paper sheet, or at least a paper sheet strip cut therefrom, is sucked onto the belt and held in place by the vacuum, and it is transported along with the running belt. The vacuum in the suction box 11 is usually created by a ventilator 14. This ventilator, like the pressure regulator valve 12 of support device 2, can be controlled via control unit 6, in order to set the required vacuum as determined by microprocessor 4. Of course, other regulating units 12, 14 can be utilized.

The values determined by microprocessor 4 are largely dependent on paper quality, and here mainly on the weight of the paper. Therefore, the machine operator should input the desired paper weight into operator unit 5 of microprocessor 4. Microprocessor 4 then determines the required air pressures by calculating them, or by retrieving empirically determined, inputted values from memory, and it passes this information to control unit 6.

It is noted that the foregoing examples have been provided merely for the purpose of explanations and are in no way to be construed as limiting of the present invention.

While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention and its aspects. Although the invention has been described herein with reference to particular devices and embodiments, t he invention is not intended to be limited to the particulars disclosed herein; rather, the invention extends to all functionally equivalent structures, methods and uses, such as are within the scope of the appended claims.

What is claimed is:

1. A process for guiding a web having a first end from a first treatment station to a second treatment station in a web manufacturing or treatment process comprising:

inputting at least one quality factor of the web into an operator unit of a microprocessor;

subsequent to inputting the at least one quality factor into the operator unit controlling air pressure in at least one pneumatic support device via information from the microprocessor in accordance with the at least one quality factor of the web; and guiding the web and feeding the first end of the web from the first treatment station to the second treatment station using the controlled air pressure of the at least one pneumatic support device.

2. The process according to claim 1, wherein the at least one pneumatic device comprises a regulating unit, the microprocessor comprises a control unit, and the regulating unit is coupled to the control unit of the microprocessor to receive the information from the control unit.

3. The process according to claim 1, wherein the information from the microprocessor comprises the air pressure to be applied in the at least one pneumatic support device.

4. The process according to claim 2, wherein the web has a web weight, and the at least one quality factor comprises web weight.

5. The process according to claim 2, wherein the web has a web weight and a web speed, and the at least one quality factor comprises web weight and web speed.

6. The process according to claim 2, wherein the web has a web weight and a web pull strength, and the at least one quality factor comprises web weight and web pull strength.

7. The process according to claim 2, wherein the web has web weight, a web speed and a web pull strength, and the at least one quality factor comprises web weight, web speed, and web pull strength.

8. The process according to claim 1, further comprising reducing the controlled air pressure.

9. The process according to claim 1, wherein the web is a paper web.

10. The process according to claim 9, wherein the at least one pneumatic device comprises a regulating unit, the microprocessor comprises a control unit, and the regulating unit is coupled to the control unit of the microprocessor to receive the information from the control unit.

11. The process according to claim 10, wherein the web has a web weight, and the at least one quality factor comprises web weight.

12. The process according to claim 10, wherein the web has a web weight and a web speed, and the at least one quality factor comprises web weight and web speed.

13. The process according to claim 10, wherein the web has a web weight and a web pull strength, and the at least one quality factor comprises web weight and web pull strength.

14. The process according to claim 10, wherein the web has a web weight, a web speed and a web pull strength, and the at least one quality factor comprises web weight, web speed, and web pull strength.

15. The process according to claim 14, further comprising reducing the controlled air pressure.

16. The process according to claim 9, wherein the paper web is a continuous paper web.

17. The process according to claim 9, wherein the paper web is a paper strip.

18. The process according to claim 1, wherein the web is a continuous paper web.

19. The process according to claim 1, wherein the web is a paper strip.

20. The process according to claim 2, wherein the web is selected from the group consisting of a continuous paper web and a paper strip.

* * * * *